US006719189B1

(12) United States Patent
Malerba

(10) Patent No.: US 6,719,189 B1
(45) Date of Patent: Apr. 13, 2004

(54) GIFT PACKAGING SYSTEM

(76) Inventor: Stephen C. Malerba, 4596 Great Lakes Dr. South, Clearwater, FL (US) 33762

( * ) Notice: Subject to any disclaimer, the term of this patent is extended or adjusted under 35 U.S.C. 154(b) by 0 days.

(21) Appl. No.: 10/465,045

(22) Filed: Jun. 19, 2003

(51) Int. Cl.[7] ..... B42D 15/00

(52) U.S. Cl. ..... 229/92.8; 283/116; 462/64; 40/124.06

(58) Field of Search ..... 229/92.8, 70; 283/57, 283/58, 116; 462/64; 40/124.06

(56) References Cited

U.S. PATENT DOCUMENTS 805,016 A * 11/1905 Jones ..... 40/530
811,658 A * 2/1906 Colwell ..... 40/530
858,313 A * 6/1907 Wells ..... 40/530
906,774 A * 12/1908 Colwell ..... 359/474
2,363,472 A * 11/1944 Ritter ..... 229/92.8
3,190,541 A * 6/1965 McLaughlin et al. ..... 229/92.8
3,672,703 A * 6/1972 Jay ..... 462/65
4,676,526 A * 6/1987 Redman ..... 281/5
4,967,951 A * 11/1990 Sherman ..... 229/70
5,487,566 A * 1/1996 Hedge, Jr. ..... 283/56
6,301,812 B1 * 10/2001 Klunk ..... 40/124.06

* cited by examiner

*Primary Examiner*—Jes F. Pascua
(74) *Attorney, Agent, or Firm*—Edward P. Dutkiewicz

(57) ABSTRACT

An envelope has a top face, a bottom face and an open lower edge. A plurality of gift items are in a generally rectangular configuration. The gift items have a top surface, a bottom surface, a first end, and a second end. The gift items have a length and a width each less that the length and the width of the envelope. A plurality of adhesive stripes are adapted to attach the plurality of gift items end to end. In this manner the gift items are held end to end when the gift items are folded in a corrugated fashion and placed within the envelope. The gift items may be removed by pulling them out from the open lower edge of the envelope.

4 Claims, 3 Drawing Sheets

FIG 5
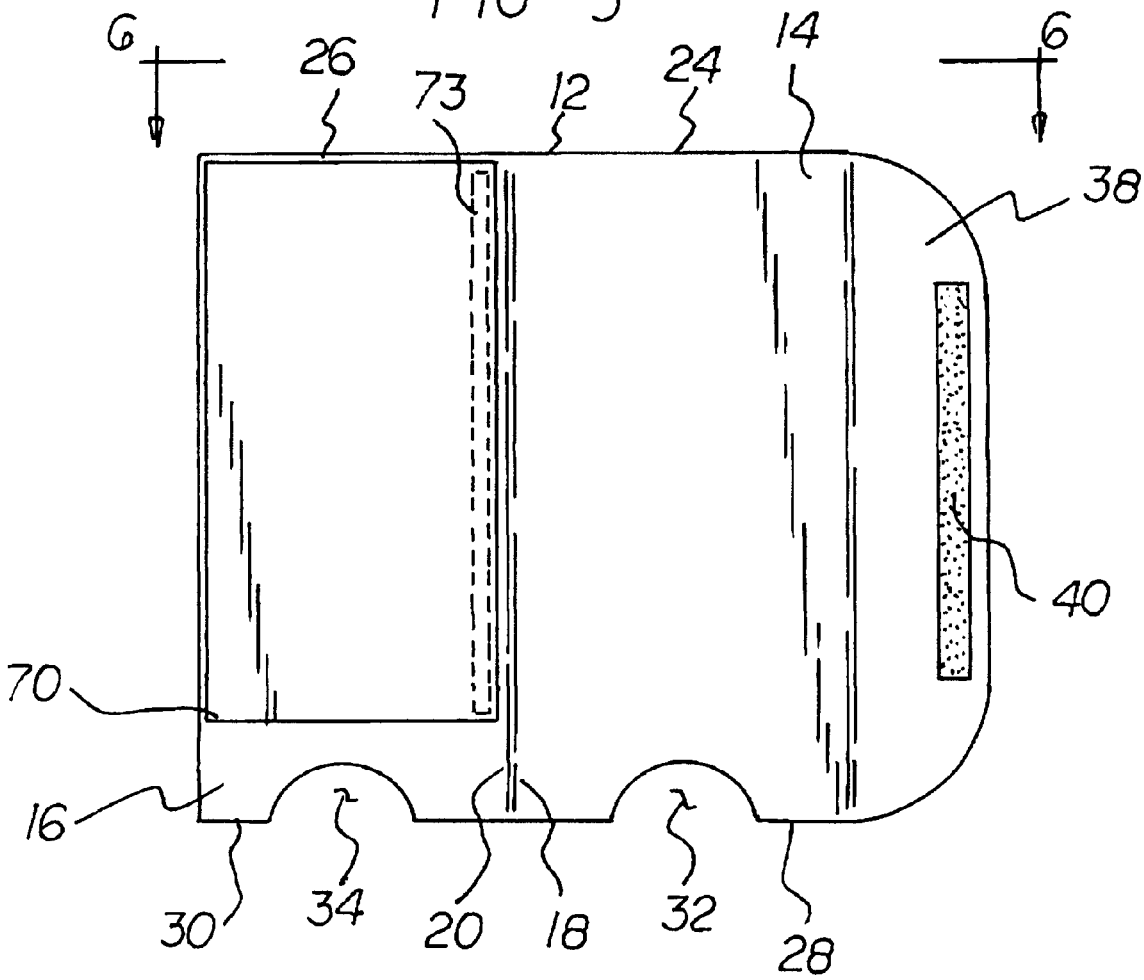
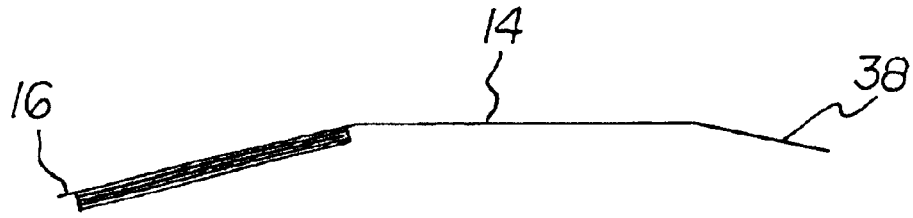
FIG 6

GIFT PACKAGING SYSTEM

BACKGROUND OF THE INVENTION

1. Field of the Invention

The present invention relates to a gift packaging system and more particularly pertains to concealing a present in an envelope so as to allow for convenient removal.

2. Description of the Prior Art

The use of packaging systems of known designs and configurations is known in the prior art. More specifically, packaging systems of known designs and configurations previously devised and utilized for the purpose of concealing presents through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,337,120 issued Aug. 22, 1967 to Steidinger relates to a packet assembly with pre-folded interior material. U.S. Pat. No. 3,955,750 issued May 11, 1976 to Huffman relates to a multi-panel envelope form. U.S. Pat. No. 4,058,251 issued Nov. 15, 1977 to Stevenson relates to a folded money pack envelope. U.S. Pat. No. 5,362,103 issued Nov. 8, 1994 to Bromberg relates to a pull-out booklet. Lastly, U.S. Pat. No. 6,406,586 issued Jun. 18, 2002 to Rodriquez fastening method and stationery articles produced thereby.

While these devices fulfill their respective, particular objectives and requirements, the aforementioned patents do not describe a gift packaging system that allows concealing a present in an envelope so as to allow for convenient removal.

In this respect, the gift packaging system according to the present invention substantially departs from the conventional concepts and designs of the prior art, and in doing so provides an apparatus primarily developed for the purpose of concealing a present in an envelope so as to allow for convenient removal.

Therefore, it can be appreciated that there exists a continuing need for a new and improved gift packaging system which can be used for concealing a present in an envelope so as to allow for convenient removal. In this regard, the present invention substantially fulfills this need.

SUMMARY OF THE INVENTION

In view of the foregoing disadvantages inherent in the known types of packaging systems of known designs and configurations now present in the prior art, the present invention provides an improved gift packaging system. As such, the general purpose of the present invention, which will be described subsequently in greater detail, is to provide a new and improved gift packaging system and method which has all the advantages of the prior art and none of the disadvantages.

To attain this, the present invention essentially comprises an envelope. The envelop is in a rectalinear configuration. The envelop has a top face and a bottom face. Each face has a length and a width. Each face has a first hinged side edge, a second side edge, an open upper edge, and an open lower edge. The open lower edge has a semicircular aperture. The top face is adapted to have indicia. The envelope further has a flap. The flap is adapted to couple to the second side edge of the top face. The flap is further adapted to hold the top face and bottom face together with an adhesive type fastener.

A message form is provided. The message form is in a generally rectangular configuration. The message form has a top surface, a bottom surface, a first end, and a second end. The message form has a length and a width. The length and the width of the message form are less than the length and the width of the face of the envelope. In this manner the message form may reside within the envelope. The message form is adapted to have printed indicia as well as a personalized message. The message form has a trailing end attached to the leading edge of a first gift item.

Provided next is a plurality of gift items. The gift items are preferably bills of monetary currency. The gift items are in a generally rectangular configuration. The gift items have a top surface, a bottom surface, a first end, and a second end. The gift items have a second length and a width. The length and width of the gift items are less that the length and the width of the envelope. The length and width of the gift items are similar to the length and the width of the message form. The second length is less than the first length.

Further provided is a plurality of spacer sheets. The spacer sheets are of a rectangular configuration. The spacer sheets are provided between a plurality of adjacent folded gift items.

Provided last is a plurality of adhesive stripes. The adhesive stripes are in a circular configuration. The adhesive stripes are adapted to attach the plurality of gift items end to end. The adhesive stripe is attached to the bottom surface of the first end of the message form to the bottom surface of the second end of the gift item. The adhesive stripes are further attached to the bottom surfaces of the gift items. In this manner the gift items are held end to end when the combined message form and the plurality of gift items are folded in a corrugated fashion and placed within the envelope. The second end of the message form is adjacent to the semicircular aperture of the lower edge of the envelope. Spacers are between each of the gift items. The combined message form and gift items may be removed by pulling them out from the open lower edge of the envelope.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gift packaging system which has all of the advantages of the prior art packaging systems of known designs and configurations and none of the disadvantages.

It is another object of the present invention to provide a new and improved gift packaging system which may be easily and efficiently manufactured and marketed.

It is further an object of the present invention to provide a new and improved gift packaging system which is of durable and reliable constructions.

An even further object of the present invention is to provide a new and improved gift packaging system which is susceptible of a low cost of manufacture with regard to both materials and labor, and which accordingly is then susceptible of low prices of sale to the consuming public, thereby making such gift packaging system economically available to the buying public.

Even still another object of the present invention is to provide a gift packaging system for concealing a present in an envelope so as to allow for convenient removal.

Lastly, it is an object of the present invention to provide a new and improved gift packaging system. An envelope has a top face, a bottom face and an open lower edge. A plurality of gift items are in a generally rectangular configuration. The gift items have a top surface, a bottom surface, a first end, and a second end. The gift items have a length and a width each less that the length and the width of the envelope. A plurality of adhesive stripes are adapted to attach the plurality of gift items end to end. In this manner the gift items are held end to end when the gift items are folded in a corrugated fashion and placed within the envelope. The gift items may be removed by pulling them out from the open lower edge of the envelope.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a front elevational view similar to FIG. 3 but prior to the envelope receiving its contents.

FIG. 6 is an end elevational view taken along line 6—6 of FIG. 5.

The same reference numerals refer to the same parts throughout the various Figures.

DESCRIPTION OF THE PREFERRED EMBODIMENT

Figure 1:
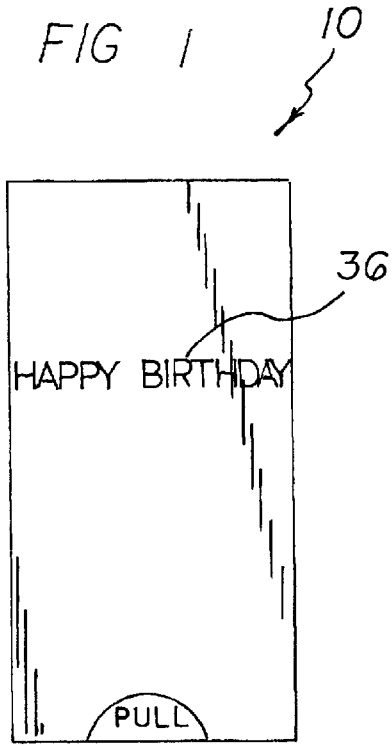
FIG. 1 is a front elevational view of a gift packaging system constructed in accordance with the principles of the present invention.
Figure 2:
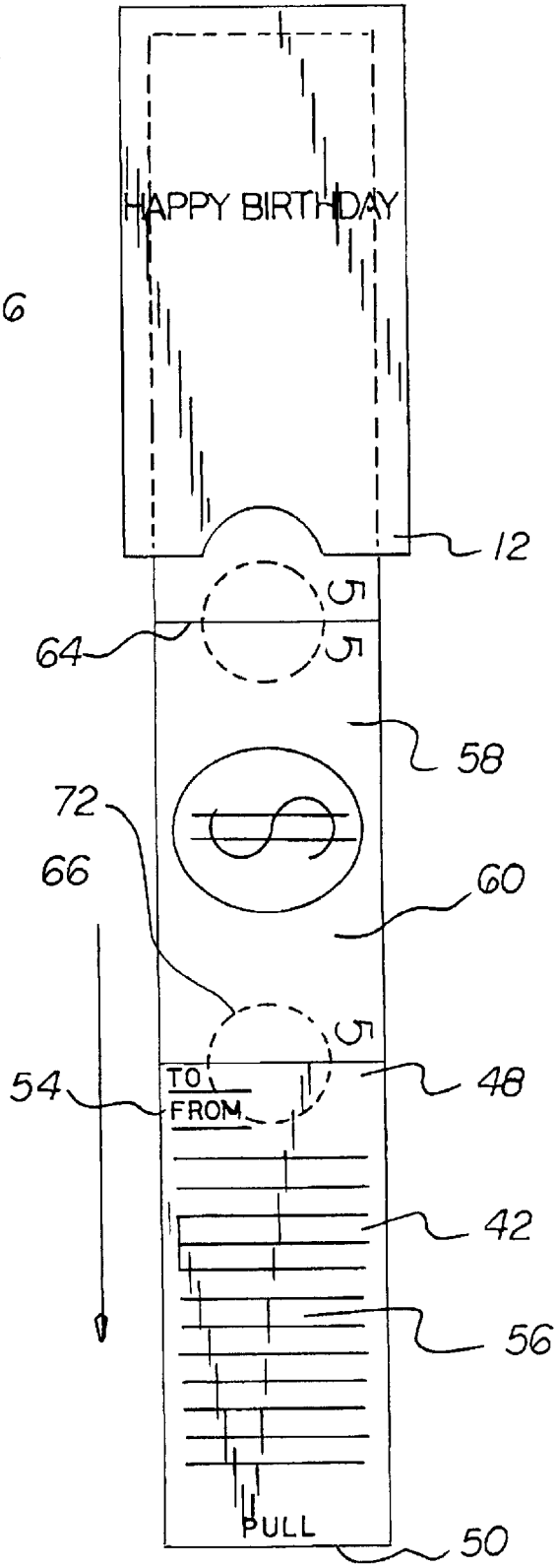
FIG. 2 is a front elevational view similar to FIG. 1 but with the gift partially removed.
Figure 3:
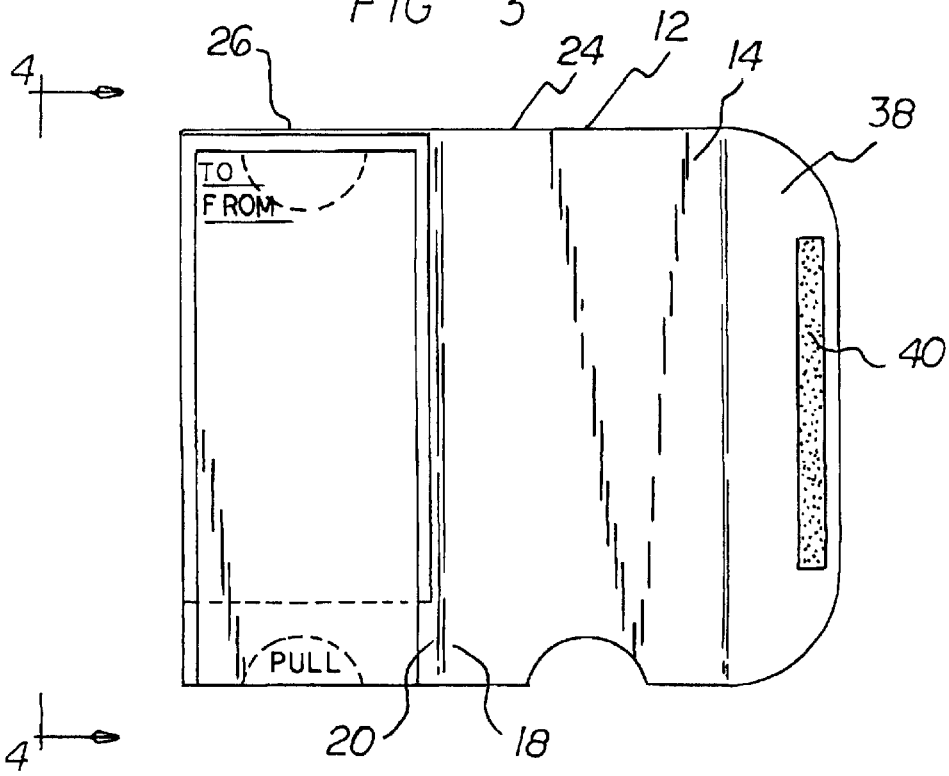
FIG. 3 is a front elevational view similar to FIG. 1 but prior to the folding and closing of the envelope.
Figure 4:
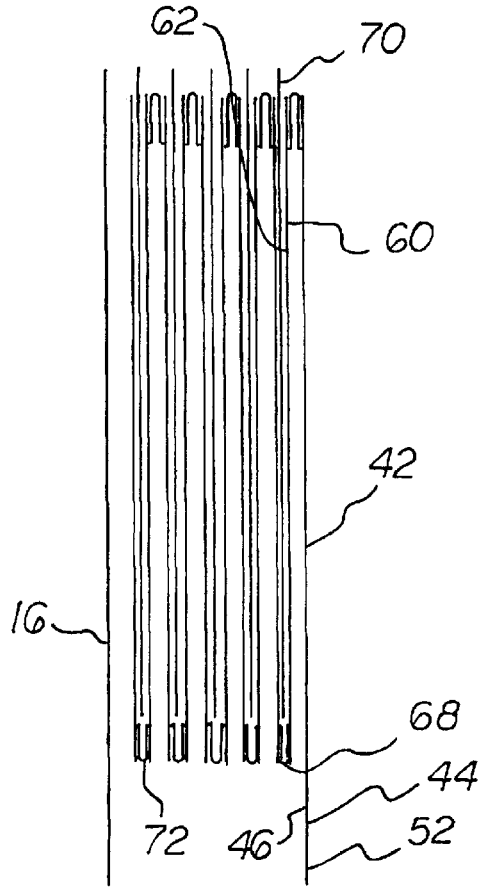
FIG. 4 is an end elevational view taken along line 4—4 of FIG. 3.

With reference now to the drawings, and in particular to FIG. 1 thereof, the preferred embodiment of the new and improved gift packaging system embodying the principles and concepts of the present invention and generally designated by the reference numeral 10 will be described.

The present invention, the gift packaging system 10 is comprised of a plurality of components. Such components in their broadest context include an envelope, a plurality of gift items, and a plurality of adhesive stripes. Such components are individually configured and correlated with respect to each other so as to attain the desired objective.

First provided is an envelope 12. The envelope is in a rectalinear configuration. The envelop has a top face 14 and a bottom face 16. Each face has a length and a width. Each face has a first hinged side edge 18, 20, a second side edge 20, 22, an open upper edge 24, 26, and an open lower edge 28, 30. The open lower edge has a semicircular aperture 32, 34. The top face is adapted to have indicia 36. The envelope further has a flap 38. The flap is adapted to couple to the second side edge of the top face. The flap is further adapted to hold the top face and bottom face together with an adhesive type fastener 40.

A message form 42 is provided. The message form is in a generally rectangular configuration. The message form has a top surface 44, a bottom surface 46, a first end 48, and a second end 50. The message form has a length and a width. The length and the width of the message form are less than the length and the width of the face of the envelope. In this manner the message form may reside within the envelope. The message form is adapted to have printed indicia 54 as well as a personalized message 56. The message form has a trailing end attached to the leading edge of a first gift item.

Provided next is a plurality of gift items 58. The gift items are preferably bills of monetary currency. The gift items are in a generally rectangular configuration. The gift items have a top surface 60, a bottom surface 62, a first end 64, and a second end 66. The gift items have a second length and a width. The length and width of the gift items are less that the length and the width of the envelope. The length and width of the gift items are similar to the length and the width of the message form. The second length 68 is less than the first length.

Further provided is a plurality of spacer sheets 70. The spacer sheets are of a rectangular configuration. The spacer sheets are provided between a plurality of adjacent folded gift items.

Provided last is a plurality of adhesive stripes 72. The adhesive stripes are in a circular configuration. The adhesive stripes are adapted to attach the plurality of gift items end to end. The adhesive stripe is attached to the bottom surface of the first end of the message form to the bottom surface of the second end of the gift item. The adhesive stripes are further attached to the bottom surfaces of the gift items. In this manner the gift items are held end to end when the combined message form and the plurality of gift items are folded in a corrugated fashion and placed within the envelope. The second end of the message form is adjacent to the semicircular aperture of the lower edge of the envelope. Spacers are between each of the gift items. The combined message form and gift items may be removed by pulling them out from the open lower edge of the envelope.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. A gift packaging system for concealing a present in an envelope so as to allow for convenient removal comprising, in combination:

an envelope in a rectalinear configuration having a top face and a bottom face, each face having a length and a width with a first hinged side edge, a second side edge, an open upper edge, and an open lower edge and with the open lower edge having a semicircular aperture, and with the top face being adapted to have indicia, the envelope further having a flap adapted to couple to the second side edge of the top face and adapted to hold the top face and bottom face together with an adhesive type fastener;

a message form in a generally rectangular configuration having a top surface, a bottom surface, a first end, and a second end, the message form having a length and a width both less than the length and the width of the face of the envelope such that the message form may reside within the envelope, the message form being adapted to have printed indicia as well as a personalized message, the message form having a trailing end attached to the leading edge of a first gift item;

a plurality of gift items in a generally rectangular configuration and having a top surface, a bottom surface, a first end, a second end and the gift items having a second length and a width each less that the length and the width of the envelope and similar to the length and the width of the message form, the second length being less than the first length;

a plurality of spacer sheets of a rectangular configuration between a plurality of adjacent folded gift items; and a plurality of adhesive stripes in a circular configuration being adapted to attach the plurality of gift items end to end, the adhesive stripe being attached to the bottom surface of the first end of the message form to the bottom surface of the second end of the gift item, furthermore the adhesive stripes being attached to the bottom surfaces of the gift items such that the gift items are held end to end, whereby when the combined message form and the plurality of gift items are folded in a corrugated fashion and placed within the envelope with the second end of the message form being adjacent to the semicircular aperture of the lower edge of the envelope with spacers between each of the gift items, the combined message form and gift items may be removed by pulling them out from the open lower edge of the envelope.

2. A gift packaging system comprising:

an envelope having a top face and a bottom face and an open lower edge;

a plurality of gift items in a generally rectangular configuration and having a top surface, a bottom surface, a first end, a second end, the gift items having a length and a width each less that the length and the width of the envelope; and a plurality of adhesive stripes adapted to attach the plurality of gift items end to end such that the gift items are held end to end, whereby when the gift items are folded in a corrugated fashion and placed within the envelope, the gift items may be removed by pulling them out from the open lower edge of the envelope.

3. The system as set forth in claim 2 and further including:

a plurality of spacer sheets of a rectangular configuration between a plurality of adjacent folded gift items.

4. The system as set forth in claim 2 and further including:

a message form in a generally rectangular configuration having a length and a width both less than the length and the width of the face of the envelope such that the message form may reside within the envelope, the message form being adapted to have printed indicia as well as a personalized message form, the message form having a trailing end attached to the leading edge of the first gift item.

* * * * *